United States Patent [19]

Kruse et al.

[11] Patent Number: 4,758,331

[45] Date of Patent: Jul. 19, 1988

[54] LOW-SULFUR FUELS FROM COALS

[75] Inventors: Carl W. Kruse, Champaign; Neil F. Shimp, Urbana; Roy J. Helfinstine; Jimmie D. Cooper, both of Champaign, all of Ill.

[73] Assignee: Board of Trustees, University of Illinois, Urbana, Ill.

[21] Appl. No.: 583,287

[22] Filed: Feb. 27, 1984

Related U.S. Application Data

[63] Continuation of Ser. No. 399,059, Jul. 16, 1982, abandoned, which is a continuation-in-part of Ser. No. 206,860, Nov. 14, 1980, abandoned.

[51] Int. Cl.[4] ..... C10G 1/00; C10G 1/06

[52] U.S. Cl. ..... 208/403; 208/407; 208/408

[58] Field of Search ..... 208/8 R, 8 LE, 10; 44/1 SR

[56] References Cited

U.S. PATENT DOCUMENTS

| | | | |
|---|---|---|---|
| 1,964,878 | 7/1934 | Hereng | 208/8 R X |
| 2,560,767 | 7/1951 | Huff | 208/8 R X |
| 3,325,395 | 6/1967 | Ban | 208/8 R X |
| 3,441,480 | 4/1969 | Ban | 208/8 R X |
| 3,475,279 | 10/1969 | Bowman | 208/8 R |
| 4,085,031 | 4/1978 | Wolchuk | 208/8 LE |
| 4,101,412 | 7/1978 | Choi | 208/8 R |
| 4,102,773 | 7/1978 | Green et al. | 208/8 R |
| 4,113,602 | 9/1978 | Gorbaty et al. | 208/10 X |
| 4,145,274 | 3/1979 | Green et al. | 208/8 R |
| 4,151,044 | 4/1979 | Choi | 208/8 R X |
| 4,155,715 | 5/1979 | Sass et al. | 44/1 SR |
| 4,220,522 | 9/1980 | Simo et al. | 208/8 R X |
| 4,276,120 | 6/1981 | Lutz | 44/1 SR X |
| 4,412,909 | 11/1983 | Faulkner et al. | 208/8 R |
| 4,419,216 | 12/1983 | Mogedanz et al. | 208/8 R |

OTHER PUBLICATIONS

Removal of Organic Sulfur by Low-Temp Carb. of Ill. Coals, C. W. Kruse et al, Ill. Inst. of Nat. Rec. State Geol. Survey Dir. 1981, pp. 124–133.

Chem. Removal of Organic Sulfur from Coal Char, Kruse, Ill State Geol. Survey, Urbana, Ill. 61801. 1980 pp. 1–32.

*Primary Examiner*—Helen M. S. Sneed
*Assistant Examiner*—William G. Wright
*Attorney, Agent, or Firm*—Philip Hill

[57] ABSTRACT

Fine particles of solid fossil fuels are pyrolyzed by passage in a thin layer through a heating zone at successively higher temperatures in a non-oxidizing atmosphere while rapidly separating and removing volatile pyrolysis products. The resulting char may be first treated with mineral acid or employed directly in the hydroprocessing of additional solid fossil fuel to liquid fuels. Alternatively, the acid-washed char may be hydrotreated to afford an improved char product having a low sulfur and mineral content.

18 Claims, 1 Drawing Sheet

LOW-SULFUR FUELS FROM COALS

The invention described herein was made in the course of work under U.S. Environmental Protection Agency Contract No. 68-02-2130. The Government of the United States has certain rights in this invention.

BACKGROUND OF THE INVENTION

This application is a continuation of application Ser. No. 399,059, filed July 16, 1982, now abandoned; which is a continuation-in-part of application Ser. No. 206,860, filed Nov. 14, 1980, now abandoned.

The energy requirements of society continue to be met principally by methods employing fossil fuels. Depletion of some liquid fossil fuel sources, together with political uncertainties concerning long-term availability of other sources, has brought increasing attention to various solid fossil fuel sources. The most plentiful of solid fossil fuels is coal.

Methods are available for direct utilization of coal, as by combustion, conversion to gaseous fuels, as by hydrogasification or water gas shift reactions, or conversion to liquid fuels, as by hydrogen donor processing. Many of the process schemes proposed lead to a series of products, comprising liquids and solids together with a variety of gaseous components ranging in heating value from about 100 up to about 1000 BTU/cu.ft.

All coals contain sulfur and mineral components in some degree. Excessive amounts of mineral components interfere with conventional combustion systems while sulfur-containing components create environmental problems when converted to hydrogen sulfide in hydroprocessing or to sulfur dioxide in combustion. The broad spectrum of coal conversion processes, as set forth above, provides products requiring additional processing to reduce the sulfur content to an acceptable level.

Among recent developments in improved processing to solid fuel products are pyrolytic approaches as exemplified in U.S. Pat. Nos. 1,964,878; 3,325,395; 3,441,480; 4,101,412; 4,102,773; 4,115,715; 4,145,274; 4,146,539; and 4,151,044. Another approach involves hydrogen processing, as in the Solvent Refined Coal (SRC-I) process described in *OCR R & D Report No.* 9, (1965).

Processing to liquid fuel products notably includes a modification of the Solvent Refined Coal (SRC-II) process and the Exxon Hydrogen Donor process, as described, for example, in *Science,* vol. 199, p. 619 (Feb. 10, 1978). These processes require additional hydroprocessing steps to afford a suitable low-sulfur, liquid fuel.

There remains a need for improved processing of coals to solid fuels, such as char or coke, having an acceptably low sulfur and mineral content. There also remains a need for improved hydroprocessing of coals to liquid fuels, having a suitably low sulfur content, including the development of new and useful catalysts and/or catalyst promoters.

SUMMARY OF THE INVENTION

In the process of this invention, solid fossil fuels are converted to low-sulfur, environmentally suitable solid or liquid fuels by a process wherein pyrolysis is first effected under conditions selected to provide a hydrogen-reactive char. Such conditions include comminution of the solid fossil fuel to afford fine particles, suitable for passage in a thin layer through a heating zone at successively higher temperatures, in an inert or non-oxidizing atmosphere, while rapidly separating and removing volatile pyrolysis products to a lower temperature zone. The char product of such pyrolysis contains active sulfur compounds, of unknown composition, which are reactive with hydrogen, either alone or in the presence of an added catalytic agent.

It is an object of this invention to provide an improved char product, having a low sulfur and mineral content, suitable for use as a fuel under environmental constraints.

It is a further object of this invention to provide an improved catalytic composition for use in donor solvent processes for the production of liquid fuels from solid fossil fuels.

DESCRIPTION OF THE DRAWING

The accompanying drawing, designated as FIG. 1, provides a simplified flow diagram, exemplary, without limitation, of certain embodiments of this invention.

Any suitable coal is first ground and screened. Fine coal particles are then subjected to pyrolysis, optionally with a countercurrent flow of gas sweeping the volatile products of the pyrolysis toward the cooler section of the zone. The pyrolyzed char may be directed to an acid leaching zone or to a slurry tank.

Figure 1:
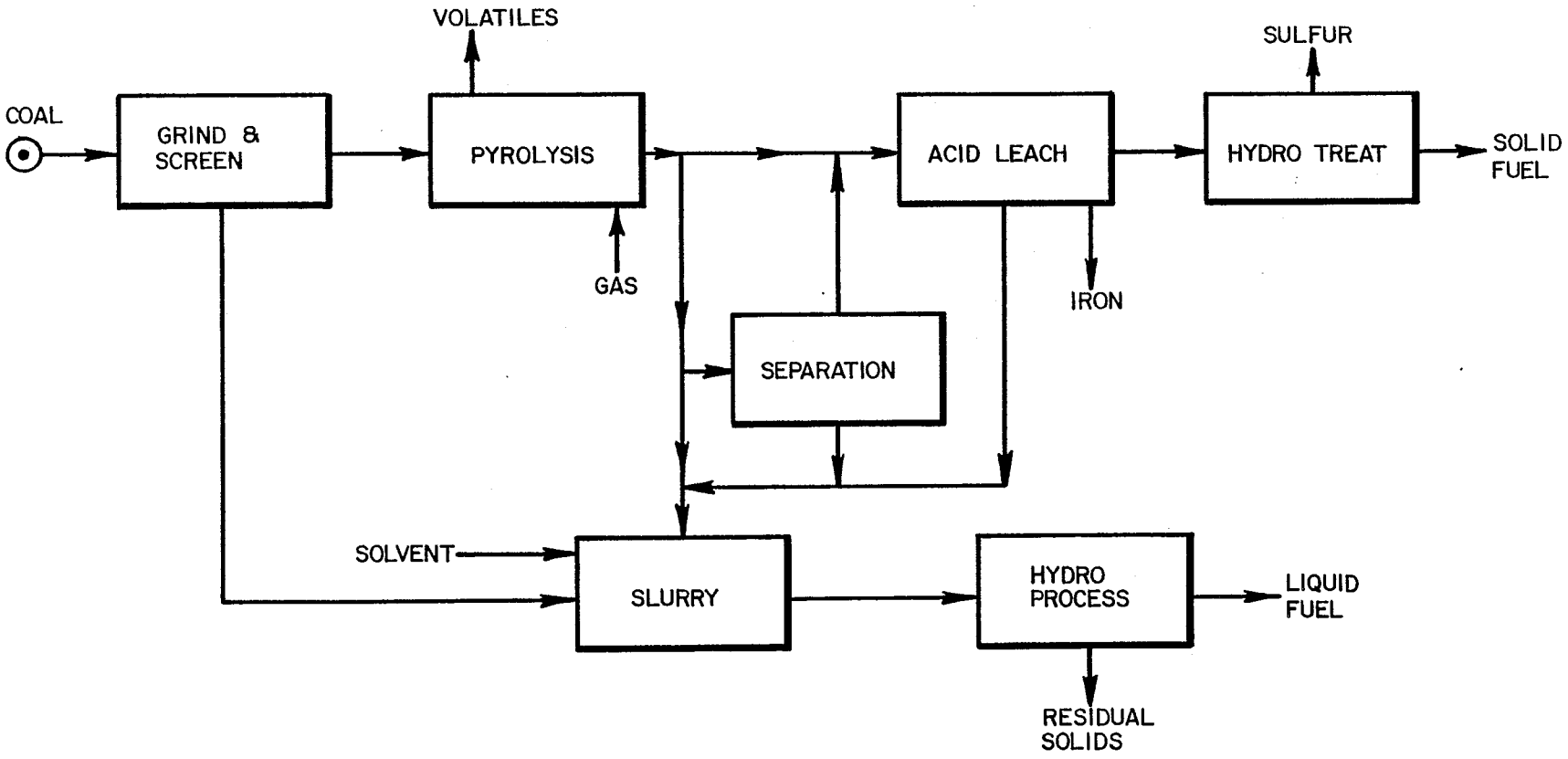

In the acid-leaching step, iron is removed from the char. The leached char may be sent to a hydrotreating operation where sulfur is removed and a low-sulfur, low-iron, solid fuel is obtained.

Alternatively, the pyrolyzed char may be directed to a separation zone, where, for example, magnetic or electrostatic means concentrate the char particles having the major amount of the iron and sulfur compounds. The remaining char particles are directed to the acid-leaching step.

The pyrolysis char, char concentrate, and/or acid-leached char, as desired, may be directed to a slurry zone where a major quantity of additional coal particles are admixed therewith, for slurrying with a naphthenic solvent oil. The resulting slurry, or paste, is then subjected to hydroprocessing to convert the bulk of the coal and char to a liquid fuel product, having a suitably low sulfur and mineral content. Residual solids are discarded from this operation.

DESCRIPTION OF THE INVENTION

The process of this invention relates to the conversion of finely-divided, sulfur-containing, solid, fossil fuel particles to low-sulfur fuels, wherein there is first afforded a hydrogen-reactive char, comprising the steps of:

(a) introducing solid fuel particles into a controlled pyrolysis zone, wherein the fuel particles are heated at progressively higher pyrolysis temperatures, whereby the fuel particles are gradually pyrolyzed to yield hydrogen-reactive char particles and volatile pyrolysis products;

(b) separating and recovering the volatile pyrolysis products; and (c) withdrawing the pyrolyzed hydrogen-reactive char particles from the controlled pyrolysis zone, and recovering and storing said char particles in an inert atmosphere.

One preferred embodiment, wherein the controlled pyrolysis zone comprises a gradient heating zone having two end sections and a number of intermediate sections may be additionally characterized as follows:

(a) there is provided in the gradient heating zone a thin layer, having an initial bed depth within the range from about 2 to about 10 mm., of the solid fuel particles, further characterized as selected to pass through a 12-mesh screen, moving unidirectionally therethrough;

(b) the thin layer of the solid fuel particles is pyrolyzed in the gradient heating zone, wherein the particles are introduced into a first end section and exposed to successive intermediate section zones having progressively higher pyrolysis temperatures, whereby the separate solid fuel particles are converted to the corresponding hydrogen-reactive char particles with the progressive liberation of the volatile pyrolysis products;

(c) the volatile pyrolysis products are continuously removed from the gradient heating zone directly into a lower-temperature recovery zone; and (d) the hydrogen-reactive char particles are withdrawn from a second end section of the gradient heating zone.

In another preferred embodiment the volatile pyrolysis products are continuously swept away from the gradually pyrolyzing fuel particles in a stream of non-oxidizing carrier gas.

The solid product of this first step consists of porous char particles having a reduced sulfur content such that the atomic ratio of sulfur to iron in the char is approximately 2.

The char product of the first step may be washed, or leached, with a strong mineral acid and with water, dried, and subjected to hydrotreating at elevated temperature and low pressure. The acid treatment removes most of the iron content of the char (typically about 80%) while the hydrogen treatment removes most of the sulfur content. The final char product thus provides a most suitable solid fuel for use even under severe environmental constraints.

Catalytic hydrogen transfer properties are exhibited by the pyrolyzed char as well as by the sulfur compounds remaining after leaching of the pyrolyzed char, particularly when high pyrolysis temperatures are avoided. This catalysis of hydrogen donor, or solvent, processes for hydroconversion of solid fossil fuels to liquid fuels provides lower sulfur contents in the fuels, thus limiting the need for secondary hydrotreating of the liquid fuel to meet environmental standards.

When thus employed as a catalyst, or catalyst promoter, the char may be employed directly or may be subjected to any magnetic, electrostatic or other physical separation means to afford a concentrate fraction containing the bulk of the sulfur and iron compounds present in the char. Acid-treated char may also be employed when the catalytic, or promotion, effect of only the sulfur compounds in the char is preferred.

The process of this invention is applicable to a great variety of solid fossil fuels, including lignites, subbituminous coals and bituminous coals. The process may be applied to any of these fossil fuels alone, or in admixture in any preferred proportion. A particularly preferred feedstock is a high-sulfur, high-volatiles bituminous coal, exemplified by Illinois No. 5 and No. 6 coals.

The sulfur content of a typical solid fossil fuel material, such as coal, is usually distributed among pyritic sulfur ($FeS_2$), inorganic sulfur (as sulfides or sulfates), and organic sulfur. The organic sulfur in most coals is distributed throughout the maceral portion while the inorganic sulfur appears generally in clusters of iron compounds.

When a fossil fuel, such as Illinois No. 6 coal, is heated under conditions of gradually increasing temperature, moisture is first removed at about 100° C., followed by successive losses of volatile organic materials as their pyrolysis temperatures are reached. Some of these materials may then thermally react, as by decomposition, when exposed to still higher temperatures. Expansion of the remaining coal material also occurs during the volatilization process and active surface sites may react with certain of the volatiles components or with their decomposition products.

We have observed that pyrolysis of a variety of coal samples, when conducted with thin layers of finely-divided coal particles, under conditions of gradually increasing temperature exposure, leads to a surprisingly uniform result when care is taken to minimize the possibility for reaction between coal surface sites and volatile products, or their decomposition products, already released from the coal. Although the original atomic ratio of sulfur to iron may vary greatly, as from about 3.1 to 5.4, and the original organic sulfur content may range from about 45% to about 62% of the total sulfur, the atomic ratio of sulfur to iron in the pyrolytic char of this process is remarkably constant at a value of substantially 2, while the pyritic sulfur content of the product char is extremely low or non-existent, although all of the original iron remains in the char. Likewise, the amount of sulfide sulfur that is liberated as hydrogen sulfide by subsequent acid treatment, with a strong, non-oxidizing mineral acid, is much less than would be expected if an iron sulfide were being dissolved.

With no intention to be limited by speculation as to reaction mechanisms, it would appear that the organic sulfur originally present in the coal is principally associated with the volatile moieties and, consequently, was removed during the pyrolysis. It would likewise appear that substantially all of the pyritic sulfur has been converted to a different form by reaction with active sites or unknown components in the coal structure, possibly involving the formation of coordination compounds. This different form appears as organic sulfur by conventional methods of analysis. However, significant and unusual activity is exhibited in the presence of hydrogen.

When the pyrolytic char is leached with acid, washed with water, and dried, it retains most of its sulfur, although its iron content is very low. This sulfur-containing char is very reactive with hydrogen at elevated temperatures such that most of the sulfur is removed by the hydrotreating. The product char from this operation affords a highly desirable solid fuel, useful under any typical, or likely, environmental standards. The product char particles may also be compressed into briquettes, particularly for use as a low-sulfur coke in steel mills, and the like.

It has been typically observed that from about 80% to about 90% of the total sulfur in a fossil fuel may be readily removed by the process of this invention, when a solid fuel product is desired. A characteristic course of sulfur and iron removal is illustrated in the following chart.

| | Feed Composition | Pyrolysis Char | Acid Leached Char | Hydro-Treated Char |
|---|---|---|---|---|
| Coal (parts by weight) | 100 | 65 | 65 | 55 |

-continued

| | Feed Composition | Pyrolysis Char | Acid Leached Char | Hydro-Treated Char |
|---|---|---|---|---|
| Sulfur (atom parts) | 100 | 60 | 50 | 10 |
| Iron (atom parts) | 30 | 30 | 5 | 5 |

The pyrolysis process of this invention is conducted under conditions selected to effect a rapid liberation of volatile matter at any given pyrolysis temperature, as well as a rapid removal of the volatile matter to a lower temperature zone, in order to minimize the possibility of any subsequent reaction between the remaining solid char and the volatile products. Although any gradient heating zone pyrolytic techniques are suitable, one preferred method for conducting the pyrolytic step employs a continuous-feed charring oven of the travelling grate type. The fine coal particles are fed onto a continuous conveyor comprising overlapping trays, preferably constructed of stainless steel, and passed steadily through an enclosed, heated zone such that the temperature of the particles gradually increases. Volatile products liberated during pyrolysis are removed through a vent system. In one preferred embodiment of this invention, a carrier gas blankets a product receiving zone, wherein the pyrolysis char is cooled, and is additionally passed, in countercurrent flow relative to the path of the solid particles, through the enclosed heating zone to sweep out rapidly all of the volative product stream through an exit line located adjacent to the particles entry zone. At least a portion of the carrier gas may also be passed upwardly through the bed of solid particles. The volatile gases, oils and tars are recovered and separately processed to fuel products.

In other preferred embodiments, pyrolysis is conducted employing a rotary tube oven, or a screw conveyor to move the particles through the zones of progressively higher temperature.

The maximum pyrolysis temperature employed in this process is within the range from about 350° C. to about 800° C. In a typical operation, the maximum temperature will be within the range from about 400° to about 750° C., and preferably from about 500° to about 700° C.

When employing a moving bed conveyor, the fossil fuel particles should first be finely ground to pass, for example, through a 12-mesh screen, and then dropped onto the moving trays to afford a layer thickness within the range from about 2 to about 10 mm. Greater depths may lead to sticking of particles to form a coke-like agglomerate, presumably because of secondary reactions occurring during traversal of the long escape path of the volatile components. A preferred particle depth is within the range from about 3 to about 8 mm.

Total residence time for particles within the pyrolysis zone may vary from about 5 to about 75 minutes although volatile components are withdrawn quickly. A preferred residence time is within the range from about 10 to about 45 minutes, most preferably from about 15 to about 25 minutes.

The carrier gas, when employed, may be any non-oxidizing gas, such as nitrogen, ammonia, argon or other rare gas, a light hydrocarbon gas, as, for example, methane, or a mixture of these. When the volatile components may be employed directly as a fuel, it is then preferred to employ a combustible gas, such as methane, as at least a component of the carrier gas.

The cooled pyrolysis char may be treated with any strong, non-oxidizing mineral acid to effect removal of iron and other metals. The leaching operation is conveniently conducted at a temperature of from about 100° to about 125° C. Suitable mineral acids include the hydrohalogen acids, sulfuric acid, and the like. A preferred acid is hydrochloric acid, employed at about 5-normal concentration. The acid-washed char is filtered, washed with water to remove residual acidity, and finally dried under non-oxidizing conditions.

To provide a char product, the sulfur content of the char particles is finally removed by contacting with hydrogen gas at a reaction temperature within the range from about 600° to about 850° C., preferably from about 750° to about 800° C. Reaction pressure may vary from atmospheric up to about 100 p.s.i.g. Hydrotreating may be continued for a time period ranging from about 0.5 to about 5 hours, preferably from about 2 to about 4 hours. In a particularly preferred operation hydrogen gas is passed through a bed of char particles at atmospheric pressure and a temperature of about 750° C.

It has been discovered that significant removal of iron and sulfur from the major portion of the pyrolytic char may be effected by magnetic or electrostatic means to provide a pyrolysis char fraction rich in the iron and sulfur moieties exhibiting catalytic, or promotional, activity with hydrogen. It is suggested that more refractory types of sulfur compounds are produced during pyrolysis and that these tend to concentrate in the vicinity of the original pyrite particles. Accordingly, the newly created physical distribution of organic sulfur approaches that of the original mineral matter. Such a separation provides, in one step, a concentrate having catalytic properties, and a low-sulfur, low-iron char which may be employed directly as a fuel, or treated, as by acid leaching and hydrotreating, to achieve the desired low level of fuel impurities.

In the production of liquid fuels from coal by "direct" methods, such as hydroprocessing, a slurry, or paste, system is generally employed at elevated temperatures and pressures. The finely divided coal particles are slurried in a naphthenic oil, which may have the tetralin or decalin structure, or in a hydrogenated creosote oil, which is similarly susceptible to hydrogen transfer reactions. Metallic catalysts, such as supported molybdenum oxide, may be added to the mixture or, in some instances, the metallic content of the coal is relied upon. Typically, the naphthenic slurry oil is recovered for recycle to the process. The product liquid fuel generally contains sufficient sulfur to require a separate hydrotreating step in order to reach acceptable specifications.

The pyrolytic char of this invention exhibits catalytic, or promotional properties, when added to the coal feed to such a hydrogen donor solvent process for providing a liquid fuel product. The entire pyrolysis char, or an iron-sulfur concentrate therefrom, may be employed. Similarly, the sulfur-containing, hydrogen-reactive, acid-leached char exhibits promoter properties in hydrogen donor processes.

Any selected char or concentrate is admixed with additional fresh solid fossil fuel to provide a feedstock for liquid fuel processing. In such an operation the char is intimately mixed with fresh feed particles in a proportion from about 1:1 to about 1:20, to provide from about 5 to about 50 wt. % char in the mixture. The solids mixture is then slurried with sufficient naphthenic oil to provide a slurry or paste comprising about 40 wt. % solids. The solids-oil mixture is then contacted with hydrogen at a temperature within the range from about 400° to about 600° C., preferably about 500° C., and a total reaction pressure within the range from about 1500 to about 3000 p.s.i., preferably about 2000 p.s.i. The liquid hourly space velocity is maintained within the range from about 1.0 to about 3.0 hr.$^{-1}$, preferably from about 1.5 to about 2.0 hr.$^{-1}$. The recovered liquid fuel, after separation from the recyclable naphthenic oil, has a low sulfur content such that further hydrotreating may not be required.

with stirring, in refluxing 5N hydrochloric acid for 30 minutes. The char was recovered, washed with water to remove chlorides, and finally rinsed with a small quantity of acetone. Analyses were conducted for sulfur and iron. Data are presented in Table II.

EXAMPLE IV

The leached char samples of Example III were further treated with flowing hydrogen at atmospheric pressure and 800° C. for 2 hours. The recovered chars were analyzed for sulfur and iron. Data are presented in Table II.

TABLE II

| | | | | | Desulfurization of Continuous-Feed Chars | | | | | | |
|---|---|---|---|---|---|---|---|---|---|---|---|
| | Initial | Pyrolysis | | | Acid Treated Char | | | Hydrotreated Char | | | Total |
| Sample No. | Sulfur, Wt. % | Temp. °C. | Depth, mm. | Time, min. | Yield, % | Sulfur, % | Iron, % | Yield, % | Sulfur, % | Iron, % | Sulfur Removal, % |
| 137 | 3.28 | 650 | 9 | 15 | 64.9 | 3.27 | 1.57 | 51.7 | 1.65 | 1.74 | 74 |
| 144 | 3.28 | 700 | 3 | 15 | 64.7 | 2.26 | 0.33 | 53.6 | 0.86 | 0.46 | 86 |
| 146 | 3.28 | 700 | 13 | 22 | 65.6 | 2.14 | 0.30 | 55.1 | 0.80 | 0.31 | 87 |
| 136 | 3.28 | 650 | 2 | 15 | 61.1 | 2.42 | 0.55 | 49.8 | 0.95 | 0.57 | 86 |
| 130 | 3.29 | 600 | 4 | 22 | 63.9 | 1.75 | 0.34 | 48.1 | 0.55 | 0.50 | 92 |
| 131 | 3.29 | 700 | 4 | 15 | 56.7 | 3.04 | 0.38 | 46.7 | 0.63 | 0.43 | 91 |
| 129 | 3.29 | 750 | 4 | 15 | 57.4 | 1.75 | 0.22 | 46.2 | 0.62 | 0.60 | 91 |
| 142 | 2.46 | 700 | 4 | 15 | 67.0 | 1.59 | 0.21 | 58.4 | 0.69 | 0.47 | 84 |
| 147 | 2.46 | 700 | 13 | 22 | 69.7 | 1.47 | 0.19 | 60.8 | 0.58 | 0.23 | 86 |

The following experimental descriptions are presented as being exemplary, without limitation, of the process of this invention.

EXAMPLE I

Various samples of Illinois No. 6 were fed through a continuous-feed charring oven, comprising firebrick enclosing a 16×16×77 cm. open-ended stainless steel shell. Close-fitting, one-piece, overlapping trays, fabricated from 0.6 mm. stainless steel were attached to a flat-bottomed, continuous conveyor trough 12.7 cm. wide and 2.5 cm. deep. One sprocket was driven by a variable speed motor. The oven was heated with two 2650-watt sheathed electrical heating elements, bent in a U-shape and extending the length of the oven.

Coal particles were fed through a gas-tight hopper and char was removed through an air lock. Volatiles were removed through an adjustable port located adjacent to the hopper. Pyrolysis results are presented in Table I for 15-minute runs.

TABLE I

| | Pyrolysis of Illinois No. 6 Coals | | | |
|---|---|---|---|---|
| Sample | Bed Depth, mm. | Exit Temp., °C. | Char Yield, wt. % | Pyrite Conversion % |
| 1 | 3 | 650 | 62 | 90 |
| 2 | 8 | 650 | 64 | 68 |
| 3 | 18 | 650 | 70 | 34 |
| 4 | 3 | 700 | 66 | 96 |
| 5 | 4 | 700 | 66 | 95 |
| 6 | 13 | 700 | 69 | 95 |

EXAMPLE II

Powdered char, containing 3.1 wt. % sulfur, was processed in contact with a High Tension Separator (Carpco Research and Engineering, Inc.) to provide a low-mineral char fraction containing only 0.3 wt. % sulfur.

EXAMPLE III

Char samples from Illinois coals, prepared by the technique of Example I, were leached by digesting,

We claim:

1. A process for the conversion of finely-divided sulfur-containing, solid, fossil fuel particles to low-mineral, low-sulfur solid fuels, comprising the steps of:

(a) providing a gradient heating zone, having first and second end sections and a plurality of intermediate sections;

(b) introducing finely-divided solid fuel particles into the first end section of the gradient heating zone as a thin layer, having an initial bed depth within the range from about 2 to about 10 mm., the solid fuel particles being further characterized as selected to pass through a 12-mesh screen, and heating the finely-divided solid fuel particles therein to incipient pyrolysis temperature;

(c) passing the thin layer of fuel particles successively through the plurality of intermediate sections of the gradient heating zone, wherein the finely-divided fuel particles are heated to progressively higher pyrolysis temperatures within the range from about 350° to about 800° C., whereby the fuel particles are partially pyrolyzed during a residence time from about 5 to about 75 minutes to yield a thin layer of hydrogen-reactive char particles and successive increments of volatile pyrolysis products, said pyrolysis products being moved countercurrently toward the first end section of the gradient heating zone;

(d) withdrawing the volatile pyrolysis products from the first end section of the gradient heating zone;

(e) withdrawing the thin layer of hydrogen-reactive char particles from the second end section of the gradient heating zone;

(f) cooling the hydrogen-reactive char particles to a temperature within the range from about 100° to about 125° C. and leaching the cooled char particles with a non-oxidizing mineral acid, whereby a major portion of the mineral content of the char is removed;

(g) washing the leached char particles with water and drying said char particles;

(h) reacting the dried char particles in a hydrogen atmosphere at a reaction temperature within the range from about 600° to about 850° C., a total reaction pressure within the range from about 0 to about 100 psig and for a time period within the range from about 0.5 to about 5 hours, whereby a major portion of the sulfur content of the char is removed; and (i) recovering a solid fuel product having a low sulfur and mineral content.

2. The process of claim 1 wherein the volatile pyrolysis products are continuously swept away from the gradually pyrolyzing fuel particles in a stream of non-oxidizing carrier gas introduced into the gradient heating zone.

3. The process of claim 1 wherein the volatile pyrolysis products are continuously withdrawn from the gradient heating zone by introduction of a stream of non-oxidizing carrier gas first directed upwardly through the thin layer of solid fuel particles toward the first end section of the gradient heating zone.

4. The process of claim 1 wherein the thin layer of finely-divided solid fuel particles is disposed upon a traveling grate maintained within the gradient heating.

5. The process of claim ! wherein the thin layer of finely-divided solid fuel particles is disposed upon a screw conveyor maintained within the gradient heating zone.

6. The process of claim 1 wherein the thin layer of finely-divided solid fuel particles is disposed within a rotary tube oven serving as the gradient heating zone.

7. The process of claim 1 wherein the solid fossil fuel is selected from the class consisting of lignites, sub-bituminous coals, bituminous coals, and mixtures thereof.

8. The process of claim 7 wherein the solid fossil fuel is a high-sulfur bituminous coal, additionally having a high volatiles content.

9. The process of claim 1 wherein the maximum pyrolysis temperature is maintained within the range from about 400° to about 750° C.

10. The process of claim 1 wherein the maximum pyrolysis temperature is maintained within the range from about 500° to about 700° C.

11. The process of claim 1 wherein the residence time is within the range from about 10 to about 45 minutes.

12. The process of claim 1 wherein the residence time is within the range from about 15 to about 25 minutes.

13. The process of claim 2 wherein the carrier gas comprises methane.

14. The process of claim 1 whrein the non-oxidizing mineral acid is hydrochloric acid diluted with water to provide about a 5-normal concentration.

15. The process of claim 1 wherein the reaction temperature is within the range from about 750° to about 800° C.

16. The process of claim 1 wherein the reaction pressure is substantially atmospheric pressure and the reaction is conducted in a stream of flowing hydrogen gas.

17. The process of claim 1 wherein the time period is within the range from about 2 to about 4 hours.

18. The process of claim 1 wherein the recovered fuel product is additionally formed into briquettes.

* * * * *